US010071417B2

(12) United States Patent
Lim et al.

(10) Patent No.: US 10,071,417 B2
(45) Date of Patent: Sep. 11, 2018

(54) INSERT FOR DIE CAST SHOT SLEEVE

(71) Applicant: PRATT & WHITNEY SERVICES PTE LTD., Singapore (SG)

(72) Inventors: Yuan Kwang Lim, Singapore (SG); Yan Seng Loh, Singapore (SG); Andrew Tan, Singapore (SG); Yao Hui Chee, Singapore (SG); Shih Han Wong, Singapore (SG); yee Ling Kwan, Singapore (SG)

(73) Assignee: United Technologies Corporation, Farmington, CT (US)

( * ) Notice: Subject to any disclaimer, the term of this patent is extended or adjusted under 35 U.S.C. 154(b) by 0 days.

(21) Appl. No.: 14/912,415

(22) PCT Filed: Jul. 9, 2014

(86) PCT No.: PCT/SG2014/000324
§ 371 (c)(1),
(2) Date: Feb. 17, 2016

(87) PCT Pub. No.: WO2015/047191
PCT Pub. Date: Apr. 2, 2015

(65) Prior Publication Data

US 2016/0184886 A1 Jun. 30, 2016

(30) Foreign Application Priority Data

Sep. 26, 2013 (SG) ..... 201307281

(51) Int. Cl.
*B22D 17/20* (2006.01)
*B22D 17/22* (2006.01)
*B22D 17/00* (2006.01)

(52) U.S. Cl.
CPC ..... *B22D 17/2023* (2013.01); *B22D 17/002* (2013.01); *B22D 17/22* (2013.01)

(58) Field of Classification Search
CPC ..... B22D 17/2023; B22D 17/203; B22D 17/2015
See application file for complete search history.

(56) References Cited

U.S. PATENT DOCUMENTS 3,201,836 A * 8/1965 Nyselius ..... B22D 17/10 164/312
3,461,946 A * 8/1969 Nyselius ..... B22D 17/2023 164/113

(Continued)

FOREIGN PATENT DOCUMENTS

CN 102847912 A 1/2013
CN 203124700 U 8/2013

(Continued)

OTHER PUBLICATIONS

International Search Report from corresponding PCT/SG14/00324.
Supplementary European Search Report for European Application No. 14847851.4 dated Apr. 13, 2017.

*Primary Examiner* — Kevin E Yoon
*Assistant Examiner* — Jacky Yuen
(74) *Attorney, Agent, or Firm* — Carlson, Gaskey & Olds, P.C.

(57) ABSTRACT

A shot sleeve for use in a die cast assembly has a shot sleeve body extending along an axis and having a bore for receiving a plunger. An insert is secured at a shot end of the shot sleeve body. A die cast assembly is also disclosed.

14 Claims, 4 Drawing Sheets

(56) References Cited

U.S. PATENT DOCUMENTS

| | | | | | |
|---|---|---|---|---|---|
| 3,516,480 | A * | 6/1970 | Woltering | B22D 17/2023 | 164/312 |
| 3,685,572 | A * | 8/1972 | Carver | B22D 17/2023 | 164/312 |
| 5,954,116 | A * | 9/1999 | Jung | B22D 17/007 | 164/113 |
| 6,425,434 | B1 | 7/2002 | Müller | | |
| 2007/0187061 | A1* | 8/2007 | Siddle | B22D 17/2023 | 164/312 |

FOREIGN PATENT DOCUMENTS

| | | | |
|---|---|---|---|
| DE | 4229273 | A1 | 3/1994 |
| JP | H0550204 | A | 3/1993 |
| JP | 05171207 | A | 7/1993 |
| JP | 09057417 | A | 3/1997 |
| JP | 10328804 | A | 12/1998 |
| JP | 11123519 | A | 5/1999 |
| JP | 2005088017 | A | 4/2005 |
| JP | 2005199347 | A | 7/2005 |

* cited by examiner

INSERT FOR DIE CAST SHOT SLEEVE

BACKGROUND

This application relates to a shot sleeve for use in a die cast mold, wherein an insert is selectively placed at a shot end of a shot sleeve body.

Die cast molds are known and, typically, include a moving mold portion and a fixed mold portion. A die cavity is formed between the two portions. A shot sleeve is an elongated member that receives a molten metal. A plunger drives the molten metal through the shot sleeve and into the die cavity.

Shot sleeves may be formed of steel for a number of reasons. As the plunger moves the molten metal through the shot sleeve, there are compressive forces applied to a shot, or forward, end of the shot sleeve. In addition, there may be prolonged temperature exposure at the shot end.

These challenges are particularly true at a portion of the shot end which is aligned with a larger portion of the die cavity and, thus faces more molten metal than a more remote portion of the shot end.

In the prior art, the shot end of the shot sleeve has sometimes developed cracks. When this occurs, the molten metal may be driven into those cracks and as a part hardens within the die cavity, the molten metal may solidify within the cracks in the shot sleeve.

In the prior art, as the moveable die portion moves away from the fixed die portion, the cast part may remain stuck within the cracks in the shot sleeve. This is, of course, undesirable.

SUMMARY

In a featured embodiment, a shot sleeve for use in a die cast assembly has a shot sleeve body extending along an axis and having a bore for receiving a plunger. An insert is secured at a shot end of the shot sleeve body.

In another embodiment according to the previous embodiment, the insert extends over only a limited circumferential portion of the shot end of the shot sleeve body.

In another embodiment according to any of the previous embodiments, the insert is secured by a threaded member into the shot sleeve body.

In another embodiment according to any of the previous embodiments, the insert defines a portion of the bore of the shot sleeve.

In another embodiment according to any of the previous embodiments, the insert is secured by a threaded member into the shot sleeve body.

In another embodiment according to any of the previous embodiments, the insert defines a portion of the bore of the shot sleeve.

In another embodiment according to any of the previous embodiments, a first distance is defined from a forward face on a plunger which is to be utilized with the shot sleeve to a rearward end of a chamfer on the plunger. The insert defines the portion of the bore for a second distance from the shot end inwardly into the bore, with the second distance being greater than the first distance.

In another embodiment according to any of the previous embodiments, the shot sleeve body is formed of a first material and the insert is formed of a second material. The first material has a lesser thermal conductivity than the second material. The second material is more resistant to high temperatures than the first material.

In another embodiment according to any of the previous embodiments, the first material is steel.

In another embodiment according to any of the previous embodiments, the second material is at least one of a nickel or nickel alloy, tungsten, tantalum, tungsten alloy, and tantalum alloy.

In another featured embodiment, a die cast assembly has a moveable mold portion and a fixed mold portion. A shot sleeve is secured within the fixed mold portion. The shot sleeve has a shot sleeve body extending along an axis, and a bore receiving a plunger that is movable along the axis. An insert is secured at a shot end of the shot sleeve, with the shot end facing one of the movable and fixed mold portions.

In another embodiment according to the previous embodiment, the insert extends over only a limited circumferential portion of the shot end of the shot sleeve.

In another embodiment according to any of the previous embodiments, the insert is secured by a threaded member into the shot sleeve body.

In another embodiment according to any of the previous embodiments, the insert defines a portion of the bore of the shot sleeve.

In another embodiment according to any of the previous embodiments, the insert is secured by a threaded member into the shot sleeve body.

In another embodiment according to any of the previous embodiments, the insert defines a portion of the bore of the shot sleeve.

In another embodiment according to any of the previous embodiments, a first distance is defined from a forward face on a plunger which is to be utilized with the shot sleeve to a rearward end of a chamfer on the plunger. The insert defines the portion of the bore for a second distance from the shot end inwardly into the bore, with the second distance being greater than the first distance.

In another embodiment according to any of the previous embodiments, the shot sleeve body is formed of a first material and the insert is formed of a second material. The first material has a lesser thermal conductivity than the second material, and the second material is more resistant to high temperatures than the first material.

In another embodiment according to any of the previous embodiments, the first material is steel.

In another embodiment according to any of the previous embodiments, the second material is at least one of a nickel or nickel alloy, tungsten, tantalum, tungsten alloy, and tantalum alloy.

These and other features may be best understood from the following drawings and specification.

DETAILED DESCRIPTION

Figure 1A:
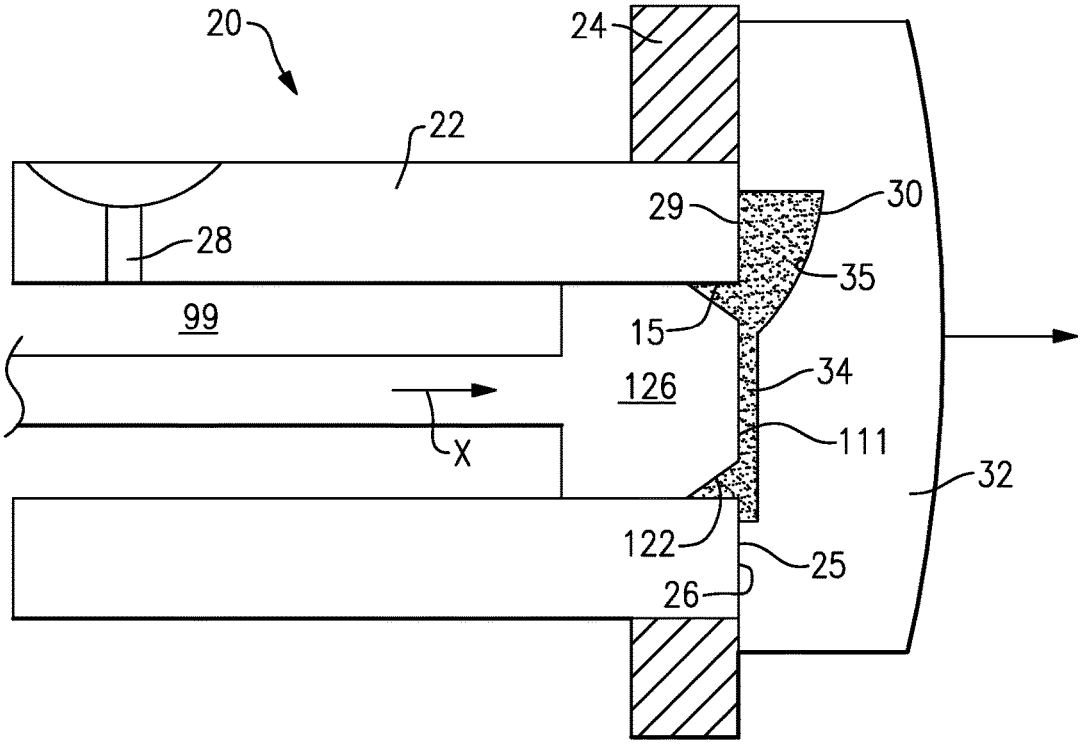
FIG.1A Prior Art
FIG. 1A shows a prior art die cast assembly somewhat schematically.

A die cast assembly 20 as known in the prior art is illustrated in FIG. 1A. The die cast mold includes a fixed mold portion 24 and a moveable mold portion 32. A cavity 35 within the moveable mold portion 32 forms a space for forming a part 30. The cavity is also in part defined by a shot or forward end 26 of a shot sleeve 22. The shot end 26 of the shot sleeve 22 includes a portion 25 remote from the formation of the part 30 and a portion at 29 which may be aligned with the cavity 35 and, thus contacting molten material forming the part 30. A "biscuit 34" is formed from of the material from the shot end of the shot sleeve 22, moving outwardly into the cavity 35.

A plunger 126 moves within the shot sleeve 22 and has a forward chamfered surface 122. As shown, chamfer 122 forces molten material against an inner surface 15 which defines a bore 99.

As is known in the art, molten material may be delivered through a pour hole 28 into bore 99 of the shot sleeve 22. The plunger 126 is then driven along an axis X within the bore 99 and drives the molten material through the shot end 26 into the cavity 35. The material forms the biscuit 34 outwardly of the chamfer 122, and forwardly of a forward end of the plunger 126.

However, as mentioned above, there are forces and thermal challenges on the shot end 26 of the shot sleeve 22. These challenges are greatest at the portion 29 of the shot sleeve 22 which is aligned with the material forming the part 30.

Figure 1B:
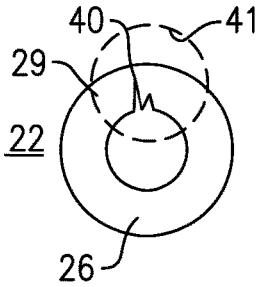
FIG.1B Prior Art
FIG. 1B shows a problem in the prior art.

Thus, as shown in FIG. 1B, adjacent the portion 29, there is an area shown within dashed line 41 that may have cracks as shown at 40. When the molten material is driven to form the part, some of the molten material may move into the cracks 40 and solidify.

Figure 1C:
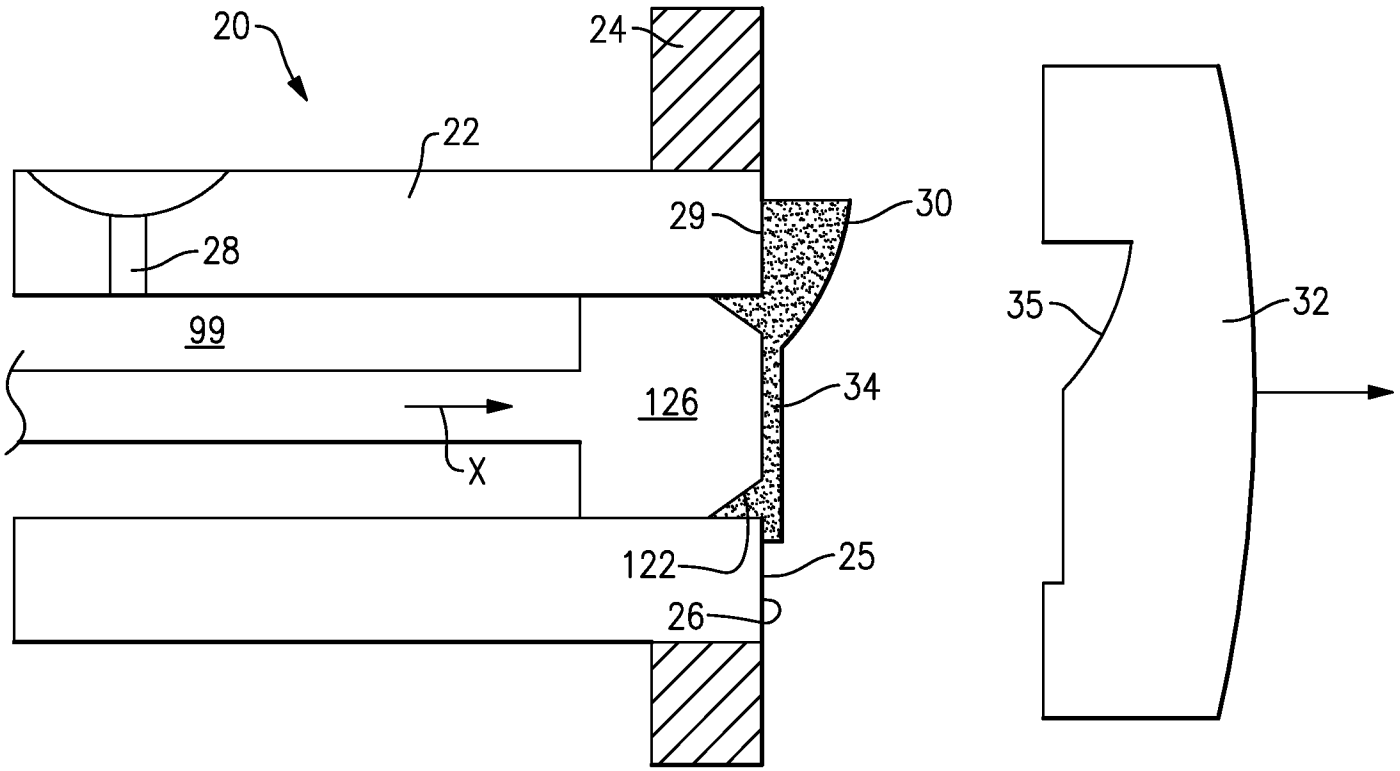
FIG.1C Prior Art
FIG. 1C shows another aspect of the prior art problem.

Thus, as shown at FIG. 1C, when the moveable mold 32 is moved away, the part 30 and biscuit 34 may remain secured to the fixed mold portion 24. It is desirable for the part to move away with the moveable mold portion 32. Further in the prior art, the part may stick with the moveable mold portion 32, but the biscuit 34 remains fixed to the shot sleeve 22. These occurrences are all undesirable.

Figure 2A:
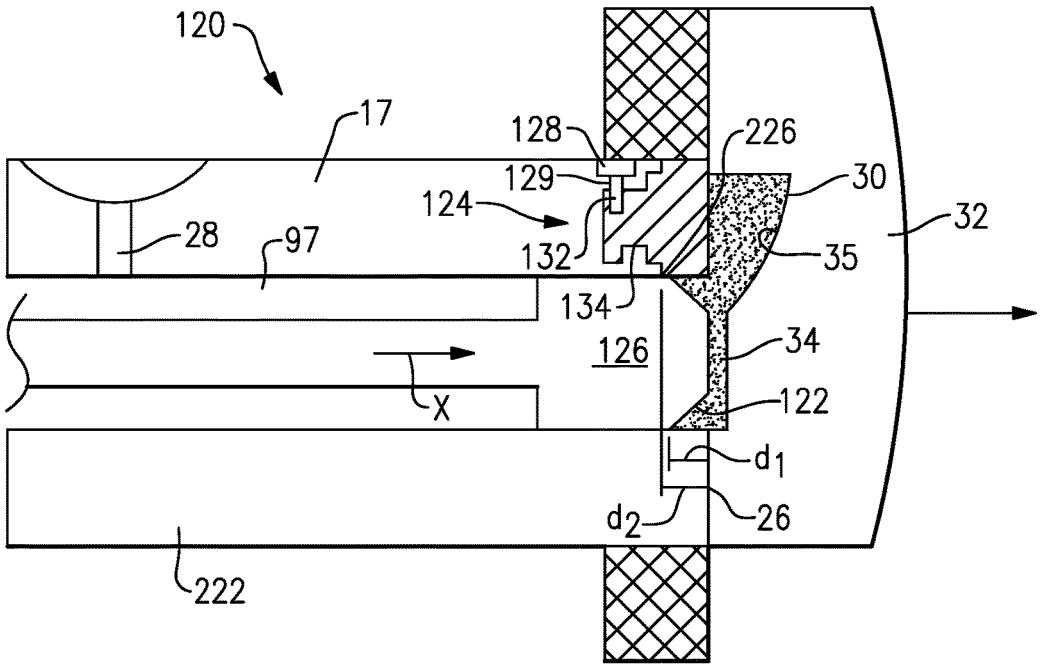
FIG. 2A shows an improved die cast assembly.

FIG. 2A shows an improved die cast assembly 120 having a shot sleeve 222. A plunger 126 has a chamfer 122 and moves along an axis X. The moveable mold portion 32 has the cavity 35 forming the part 30 and a biscuit 34. However, an insert 124 is positioned at the forward or shot end 26 of the shot sleeve 222 and, in particular, at a location aligned with the cavity 35. As is clear, the forward end, or shot end, 26 faces the movable mold portion 32. The insert 124 is shown secured within a body 17 of shot sleeve 222 by a threaded member, such as a bolt 128. The bolt 128 may be threaded at 129 into the shot sleeve body 17 and extending into an opening 132 in the insert 124. As shown, the chamfer 122 extends rearward away from a forward end 111 of the piston. It is across this distance that the radially outward force is greatest.

As is clear, pour hole 28 is spaced relative to the insert 124 along an axial direction defined as a center axis of said bore 97. In addition, as can be appreciated from FIG. 2A, the insert 124 is circumferentially aligned with the pour hold 28.

The insert 124 has a radially inner portion which defines a part of a bore 97 of the shot sleeve 222 and moves into the bore 97 to an innermost end 226 which is spaced from the shot end 26 by a distance $d_2$. As shown in FIG. 2A, $d_2$ extends further into the bore 97 than is $d_1$. Thus, the area through which material may be forced outwardly to create stresses within inner bore 97 (that is the area aligned with the chamfer 122) is shorter than the length of the insert 124 to the point 226. Thus, the insert 124 will provide resistance to cracking such as that experienced in the prior art shown in FIG. 1B.

There is a complex surface 134 to the insert 124, which serves to better secure the insert 124 within the shot sleeve 222.

The shot sleeve body 17 is preferably formed of steel, while the insert 124 is preferably formed of a high temperature resistant material such as nickel, nickel alloys, tungsten, tungsten alloys, tantalum, tantalum alloys or other heat resistant materials. In general, the steel has less thermal conductivity than the material of the insert. This makes steel desirable for the shot sleeve body as a high thermal conductivity might cool the molten metal along the length of the shot sleeve 222. On the other hand, the greater temperature resistance of the insert 124 provides more resistance to the cracking as described above. While the specific disclosure has the shot sleeve body 17 and insert 124 formed of different materials, any number of materials could be used for either component. In some embodiments, the same material may be utilized for both.

Figure 2C:
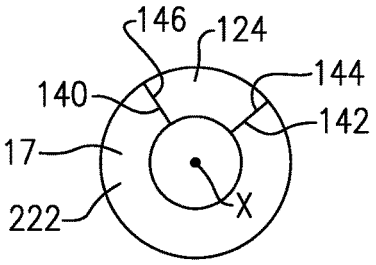
FIG. 2C is an end view of the FIG. 2A/2B shot sleeve.
Figure 2B:
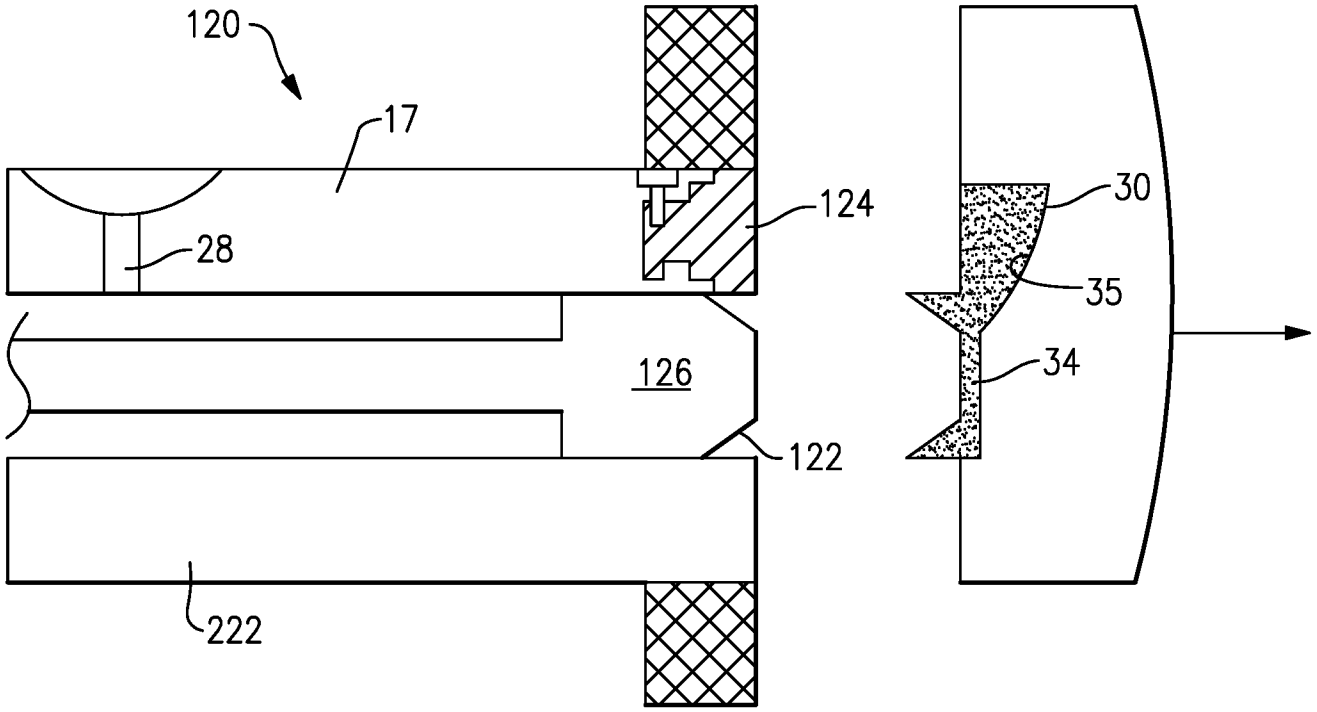
FIG. 2B shows the operation of the improved die cast assembly.

As shown in FIG. 2C, the insert 124 may extend between circumferential edges 140 and 142, and the shot sleeve body 17 may extend between circumferential edges 144 and 146. The circumferential direction is defined about the axis of movement X of the plunger 126.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. A shot sleeve for use in a die cast assembly comprising:

a shot sleeve body extending along an axis and having a bore for receiving a plunger;

an insert secured at a shot end of said shot sleeve body;

wherein said insert extends over only a limited circumferential portion of said shot end of said shot sleeve body, circumferential being defined about said axis; and said insert defining a portion of said bore of said shot sleeve body, and a pour hold extending through said shot sleeve body, and said pour hole being axially spaced from said insert along said axis.

2. The shot sleeve as set forth in claim 1, wherein said insert is secured by a threaded member into said shot sleeve body.

3. The shot sleeve as set forth in claim 1, wherein a first distance is defined from a forward face on said plunger which is to be utilized with said shot sleeve to a rearward end of a chamfer on said plunger, and said insert defines said portion of said bore for a second distance from said shot end inwardly into said bore, with said second distance being greater than said first distance.

4. The shot sleeve as set forth in claim 1, wherein said shot sleeve body is formed of a first material and said insert is formed of a second material, with said first material having a lesser thermal conductivity than said second material, and said second material being more resistant to high temperatures than said first material.

5. The shot sleeve as set forth in claim 4, wherein said first material is steel.

6. The shot sleeve as set forth in claim 5, wherein said second material is at least one of a nickel or nickel alloy, tungsten, tantalum, tungsten alloy, and tantalum alloy.

7. The shot sleeve as set forth in claim 1, wherein said insert is circumferentially aligned with said pour hole.

8. A die cast assembly comprising:

a moveable mold portion and a fixed mold portion, and a shot sleeve secured within said fixed mold portion;

the shot sleeve having a shot sleeve body extending along an axis, and a bore receiving a plunger that is movable along the axis;

an insert secured at a shot end of said shot sleeve, with the shot end facing one of the movable and fixed mold portions;

wherein said insert extends over only a limited circumferential portion of said shot end of said shot sleeve body, circumferential being defined about said axis; and said insert defining a portion of said bore of said shot sleeve body, and a pour hole extending through said shot sleeve body, and said pour hole being axially spaced from said insert along said axis.

9. The die cast assembly as set forth in claim 8, wherein said insert is secured by a threaded member into said shot sleeve body.

10. The die cast assembly as set forth in claim 8, wherein a first distance is defined from a forward face on said plunger which is to be utilized with said shot sleeve to a rearward end of a chamfer on said plunger, and said insert defines said portion of said bore for a second distance from said shot end inwardly into said bore, with said second distance being greater than said first distance.

11. The die cast assembly as set forth in claim 8, wherein said shot sleeve body being formed of a first material and said insert being formed of a second material, with said first material having a lesser thermal conductivity than said second material, and said second material being more resistant to high temperatures than said first material.

12. The die cast assembly as set forth in claim 11, wherein said first material is steel.

13. The die cast assembly as set forth in claim 12, wherein said second material is at least one of a nickel or nickel alloy, tungsten, tantalum, tungsten alloy, and tantalum alloy.

14. The die cast assembly as set forth in claim 8, wherein said insert is circumferentially aligned with said pour hole.

* * * * *